US006142463A

United States Patent [19]

Leichnitz et al.

[11] Patent Number: 6,142,463

[45] Date of Patent: Nov. 7, 2000

[54] LIFTING DRIVE SYSTEM FOR AN AUTOMATIC PILE CHANGING DEVICE

[75] Inventors: Harmut Leichnitz, Muhlheim; Michael Dotzert, Friedrichsdorf, both of Germany

[73] Assignee: MAN Roland Druckmaschinen AG, Germany

[21] Appl. No.: 09/135,763

[22] Filed: Aug. 18, 1998

[30] Foreign Application Priority Data

Aug. 19, 1997 [DE] Germany ..... 197 35 895

[51] Int. Cl.[7] ..... B65H 1/30

[52] U.S. Cl. ..... 271/159; 271/158; 271/157; 271/147

[58] Field of Search ..... 271/147, 157, 271/158, 159, 218; 414/926

[56] References Cited

U.S. PATENT DOCUMENTS 4,021,710 5/1977 Fichte et al. ..... 271/159

5,556,252 9/1996 Kuster ..... 271/155

5,626,335 5/1997 Radwanski et al. ..... 271/159

*Primary Examiner*—Donald P. Walsh

*Assistant Examiner*—Jonathan R. Miller

*Attorney, Agent, or Firm*—Leydig, Voit, Mayer, Ltd.

[57] ABSTRACT

A lifting device for an automatic pile changing device of a sheet-processing machine, in particular for a sheet-fed offset printing machine with a non-stop feeder, having a main pile-carrying assembly and an auxiliary pile-carrying assembly which can be raised and lowered by means of a motor and an upstream drive unit. The invention allows simple and cost effective synchronization of the main pile-carrying assembly and of the auxiliary pile-carrying assembly within given tolerances. According to the invention, this is achieved by switching signals of equal duration determined by a common control unit coordinating two drive units. At least one of the drive units is assigned parameters that enable this synchronization.

14 Claims, 3 Drawing Sheets

LIFTING DRIVE SYSTEM FOR AN AUTOMATIC PILE CHANGING DEVICE

TECHNICAL FIELD OF THE INVENTION

This invention relates to a lifting drive system for an automatic pile changing device, and more particularly, to a lifting drive for a sheet-fed offset printing machine with a non-stop feeder.

BACKGROUND OF THE INVENTION

In sheet-fed offset printing machines, the print carrier can have a thickness of up to an order of magnitude of 1 mm and can be transported through the machine at speeds as high as 10,000 to 15,000 sheets per hour, causing the piles in the feeder of these machines to be depleted relatively quickly. In order to maintain a high speed print run without interruption, a new pile must be precisely positioned below the residual pile and then combined with the residual pile. For this purpose, automatic pile changing devices have been developed by which the residual pile can be removed from a pallet located on a main pile-carrying assembly, allowing the main pile-carrying assembly to be lowered so that a new pile can be placed on the main pile-carrying assembly in a position precisely below the residual pile. These known pile changing devices use horizontally movable bars (carrying bars) mounted on a vertically movable frame to receive the residual pile.

The major components of the main pile-carrying assembly of the feeder are a plate for holding the main pile of sheets and a lifting device for moving the plate up and down. The auxiliary pile-carrying assembly has a lifting device for moving a frame up and down, and the frame has a pair of horizontally moveable arms for holding a sheet pile. Both the main pile-carrying assembly and the auxiliary pile carrying assembly each have their own motors and controllers (drive units). The drive units, arranged upstream of the motors, can be used to select an operating point for each motor. This operating point represents the switch-on frequency and the switch-on period of the motors and is selected as a function of the operating cycle of the printing machine and the thickness of the print carrier. If the print carrier is thick and the operating cycle of the printing machine is high, the motors for the main pile-carrying assembly and the auxiliary pile-carrying assembly are consequently switched on more frequently and for longer periods of time. In order to keep the top of the feeder pile (held either by the main pile-carrying assembly or the auxiliary pile-carrying assembly) at the proper height for feeding to the printing machine, a pile height scanner is arranged at the top of the feeder. This pile height scanner detects the height of the feeder pile and sends corresponding signals to the respective drive units assigned to each motor.

During pile changing operations, the auxiliary pile-carrying assembly is moved vertically to a position that allows the carrying bars to be extended horizontally between the top of the pallet and the underside of the feeder pile. Insertion of the bars at the appropriate moment requires syncronicity between the lifting movement of the auxiliary pile-carrying assembly and the lifting movement of the main pile-carrying assembly. After the carrying bars of the auxiliary pile-carrying assembly have received the residual pile, the main pile-carrying assembly is then lowered with the pallet in order to load it with a new pile.

Since the auxiliary pile-carrying assembly and the main pile-carrying assembly each carry different loads, their associated motors and lifting devices have mechanical and electrical differences. In the lifting devices, for example, the corresponding traction mechanisms and transmissions are different. Thus, to achieve the required syncronicity between the auxiliary pile-carrying assembly and the main pile-carrying assembly, complex measures have to be taken.

One method of synchronization is to use a sensor to detect the movement of the main pile-carrying assembly and generate the appropriate movement commands for the motor of the auxiliary pile-carrying assembly. However, this complicates the construction considerably. Another possibility is to adjust the motor of the auxiliary pile-carrying assembly during the synchronous movement according to suitable standard algorithms based on signals from the pile height scanner. But this requires an additional control unit arranged upstream of the motor of the auxiliary pile-carrying assembly to evaluate the scanner signals or it would require the current control unit to have appropriate computing capacity.

SUMMARY OF THE INVENTION

It is, therefore, the object of the present invention to provide an improved lifting drive system for an automatic pile changing device which allows simple and cost-effective synchronous movement of a main pile-carrying assembly and an auxiliary pile-carrying assembly within given tolerances, while avoiding the aforementioned disadvantages.

According to the invention, at least one of the drive units assigned to the lifting devices of the main pile-carrying assembly and the auxiliary pile-carrying assembly has a means for receiving a control signal and regulating the flow of current to the attached motor according to a set of parameters so as to move the corresponding lifting device for the correct distance and at the correct speed.

In a preferred embodiment of the invention, the drive unit for the auxiliary pile-carrying assembly is equipped with a microprocessor having an associated programmable memory. The drive unit of the auxiliary pile-carrying assembly receives a series of "switch-on" signals that are calibrated for the motor of the main pile-carrying assembly. Since the motor of the main pile-carrying assembly has speed and acceleration characteristics that are different from those of the motor for the auxiliary pile-carrying assembly, these "switch-on" signals will not be of the correct frequency and duration to cause the motor of the auxiliary pile-carrying assembly to move the assembly the proper distance and at the proper speed. In order to convert the "switch-on" signal to the proper frequency and duration, the memory is programmed with a look-up table containing a set of values representing the "switch-on" frequency and "switch-on" duration required by the motor for a given "switch-on" signal received from upstream. These values are obtained from the experimentally observed differences in speed and acceleration between the two motors. This enables the lifting device of the auxiliary pile-carrying assembly to be moved the same vertical distance as the main pile-carrying assembly when the drive units receive a pair of "switch-on" signals having the same frequency and duration.

In this manner, the motors of the main pile-carrying assembly and the auxiliary pile-carrying assembly can be synchronized so that it is possible to assign a common control unit to both drive units. This control unit is connected to the pile height scanner and generates switch-on commands with a given frequency and for a predetermined period of time that correspond to the operating point defined by the thickness of the print carrier and the operating cycle of the machine.

In an alternative embodiment of the invention, the programmable memory of the drive unit of the auxiliary pile-carrying assembly is programmed with a function relating the speed and acceleration characteristics of the two motors. The conversion from a "switch-on" signal calibrated to the motor of the main pile-carrying assembly to one calibrated to the motor of the auxiliary pile-carrying assembly occurs by performing this function upon the received "switch-on" control signal.

It is also possible that the switching commands for the motors of the main pile-carrying assembly and of the auxiliary pile-carrying assembly may not be transmitted at the same time to their corresponding drive units. The operation of the motors will consequently not take place synchronously. However, with an appropriate selection of parameters that take into account the required mechanical tolerances, such time delays will not have an adverse effect, since it is only important for the same paths to be traveled at specific time intervals.

The synchronization provided by this invention thus not only has the advantage that the motors for the main pile-carrying assembly and the auxiliary pile-carrying assembly can be operated by a single control unit generating switching signals of equal length, but is also advantageous in that it can be operated by feeding the switching signals to the respective motors at different points in time.

In other modes of operation, the drives can be moved independently. Such independent motion is necessary when moving the auxiliary pile-carrying assembly at a relatively high speed to reach a position to lift the pile from the main pile-carrying assembly at the same time the main pile-carrying assembly is moving according to signals from the pile height sensor. Another situation requiring independent motion is after the residual pile has been loaded onto the carrying bars of the auxiliary pile-carrying assembly. During loading, the auxiliary pile-carrying assembly will be moving according to signals from the pile height sensor. At that time, the main pile-carrying assembly must be lowered at a higher speed to a position enabling a new pile to be loaded onto the pallet.

In summary, an advantage of this invention is that the drives of the main pile-carrying assembly and of the auxiliary pile-carrying assembly can be supplied with appropriate switching signals using only one control unit receiving signals from the pile height scanner. In the synchronous mode of operation, switch-on signals of equal length (but not necessarily of the same phase) are provided by the control unit causing the auxiliary pile-carrying assembly and the main pile-carrying assembly to cover the same lifting paths. This results from an appropriate parameter assignment in the drive unit associated with the auxiliary pile-carrying assembly. In the independent mode of operation, the switch-on signal for either motor may be of a length different that of the other motor. Also, one or both motors may be operated with a continuous switch-on signal.

DESCRIPTION OF THE INVENTION

While particular embodiments of the invention have been shown, it will be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

Figure 1:
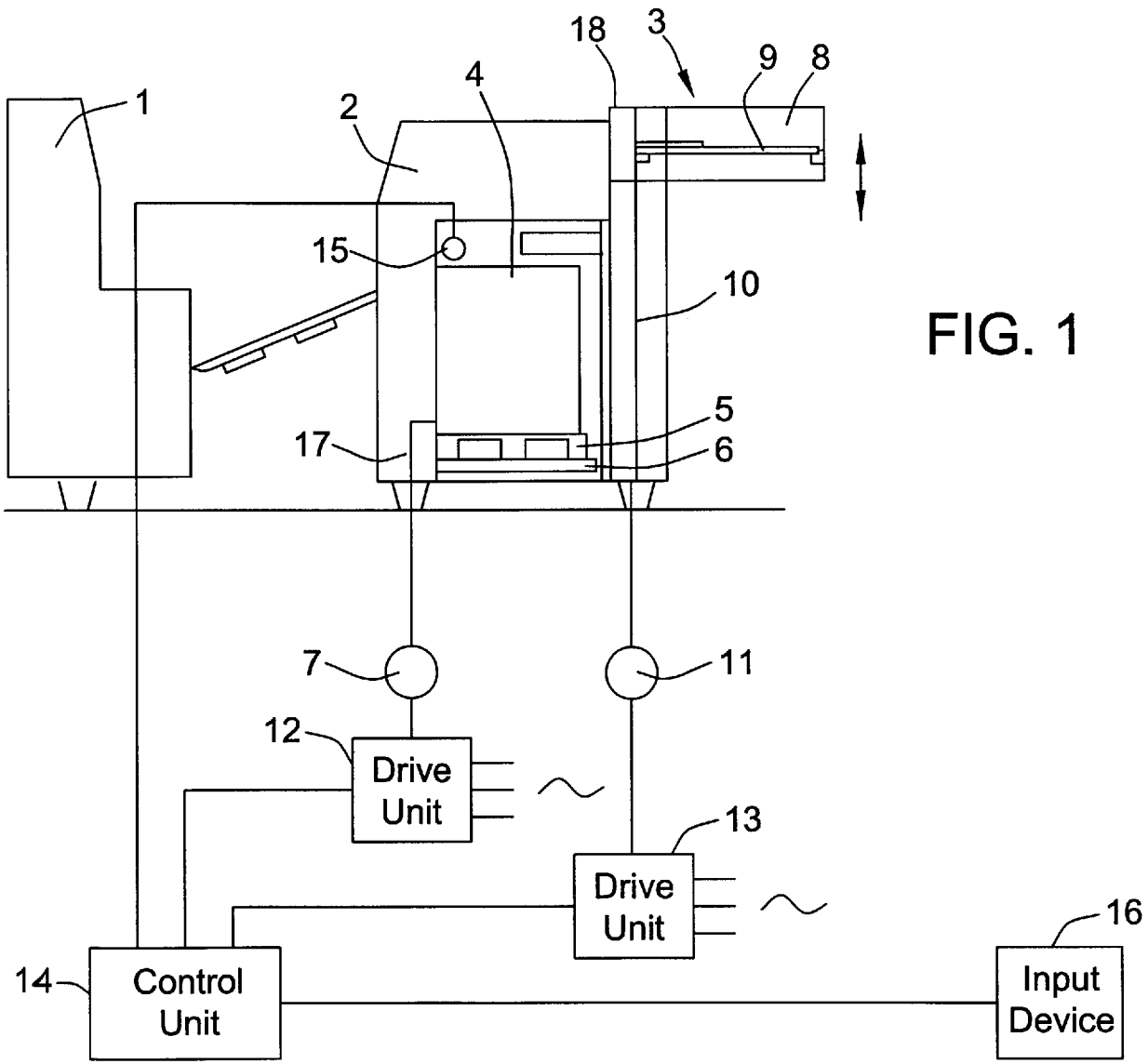
FIG. 1 shows a feeder with an auxiliary pile-carrying assembly, the corresponding motors with the drive units, and the control unit.

FIG. 1 shows a sheet-fed offset printing machine 1 (first printing unit), to which sheets are fed by a feeder 2 via a feed table. In the feeder 2, a pile 4 is set down on a main pile-carrying assembly 6 on a pallet 5, from the top of which pile sheets are removed with the cycle of the machine and are fed to the feed point via the feed table. The main pile-carrying assembly 19 has a plate 6 and a lifting device 17, whereby the pile 4 in the feeder 2 can be raised and lowered via a motor 7. Assigned to the feeder 2 is an auxiliary pile-carrying assembly 3, which is configured as a frame 8, which is vertically movable along guide rails 10 on the feeder 2, with horizontally movable carrying bars 9 arranged therein.

When the auxiliary pile-carrying assembly 3 has been moved to a predetermined height level, the carrying bars 9 can be inserted by a drive means (not illustrated) between the underside of the pile 4 and the top of the pallet 5 to remove the pile 4. The mode of action and configuration of the carrying bars 9 of the auxiliary pile-carrying assembly 3 of the type shown in FIG. 1 are known per se and are described in detail in the document DE 197 04 285 A1, which is not a prior publication. The frame 8 of the auxiliary pile-carrying device 3 can be moved by means of a lifting device 18 along the guide rails 10 on the feeder 2 via a motor 11.

Figure 4:
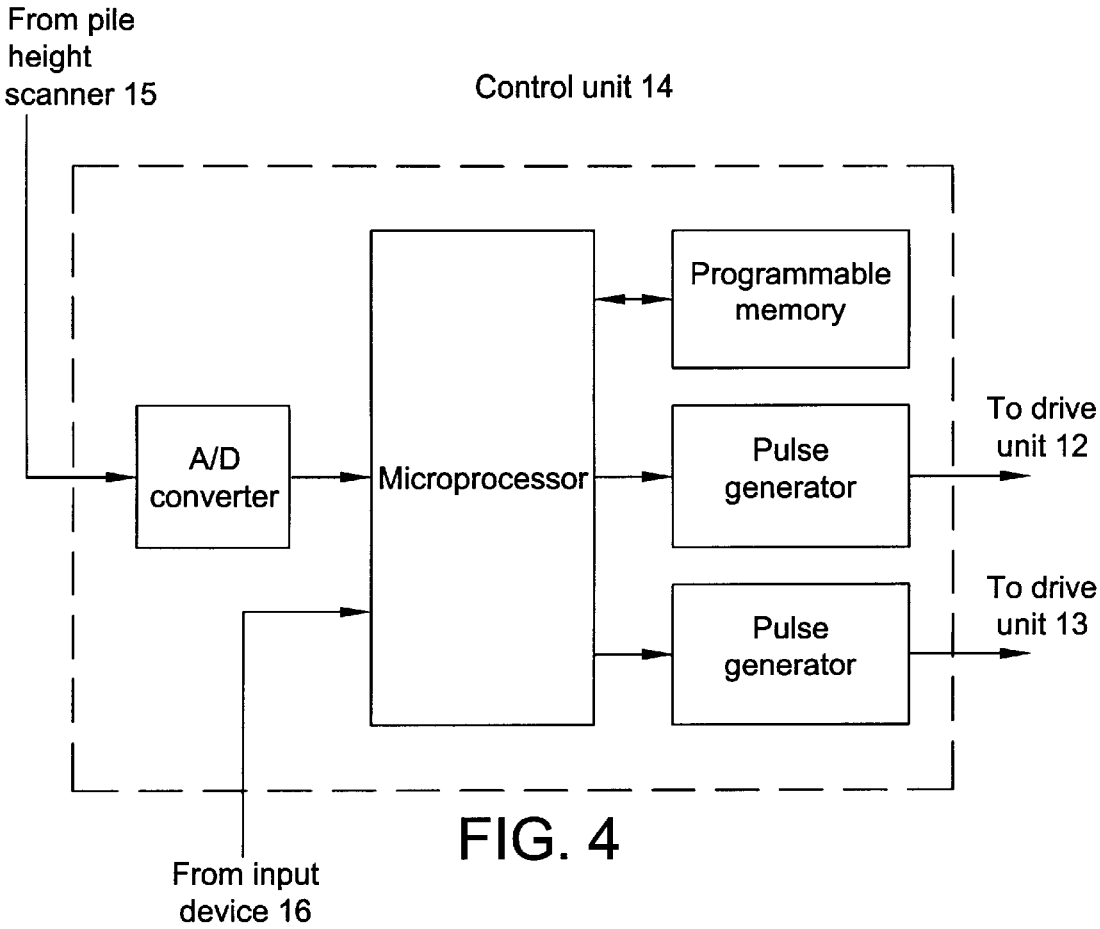
FIG. 4 shows a possible configuration of the control unit.
Figure 5:
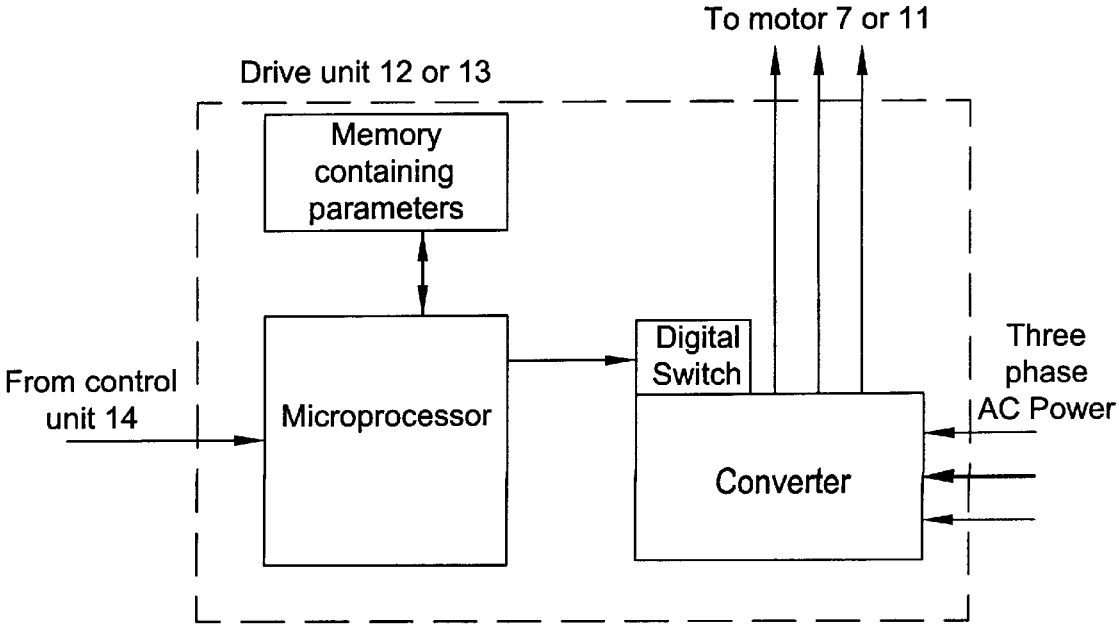
FIG. 5 shows a possible configuration of either drive control unit.

Assigned to the motor 7 for the main pile 4 of the feeder 2 and to the motor 11 of the auxiliary pile-carrying assembly 3, in each case corresponding to the configuration of the motors, are drive units 12 and 13 each of which can comprise a power supply in conjunction with a microprocessor and programmable memory and are depicted in FIG. 5. By means of the drive units 12 and 13, the motors 7 and 11 are powered in a suitable manner in accordance with predetermined switch-on signals. The main connections of the drive control 12 and 13 are indicated in FIG. 1. The drive units 12 and 13 are operatively connected to a control unit 14 which carries out the entire pile changing operation and the adjustment of the lifting movements. The control unit may comprise an analog to digital converter in conjunction with a microprocessor, programmable memory, and two pulse generators and is depicted in FIG. 4.

A pile height scanner 15 for the pile 4 in the feeder 2 in the form of a sensor is furthermore connected to the control unit 14. In this case, appropriate signals can be taken from the sensor of the pile height scanner 15 at precisely the time when the top edge of pile 4 comes to rest within a predetermined height level. Correspondingly, switching signals are generated by the control unit 14 and are fed to the drive unit 12 of the main pile-carrying assembly 19 of the feeder 2 or, via the drive unit 13, to the auxiliary pile-carrying assembly 3. A further input device 16 is furthermore connected to the control unit 14, by means of which an automatic pile changing operation with the corresponding lifting movements of the auxiliary pile-carrying assembly 3 and the retraction and extension of the carrying bars 9 as well as the raising and lowering of the main pile-carrying assembly 19 of the feeder 2 can be triggered manually. The drive units 12 and 13 of the drives 7 and 11 of the feeder 2 and of the auxiliary pile-carrying assembly 3 are configured to be programmable or to be capable of being assigned parameters. By determining appropriate parameters, motors 7 and 11 (powered by the drive unit 12 and 13 respectively) can be accelerated with a defined gradient to a predetermined rotational speed and subsequently halted at the end of the switch-on signal with a predetermined downward gradient (switch-off time).

Figure 2:
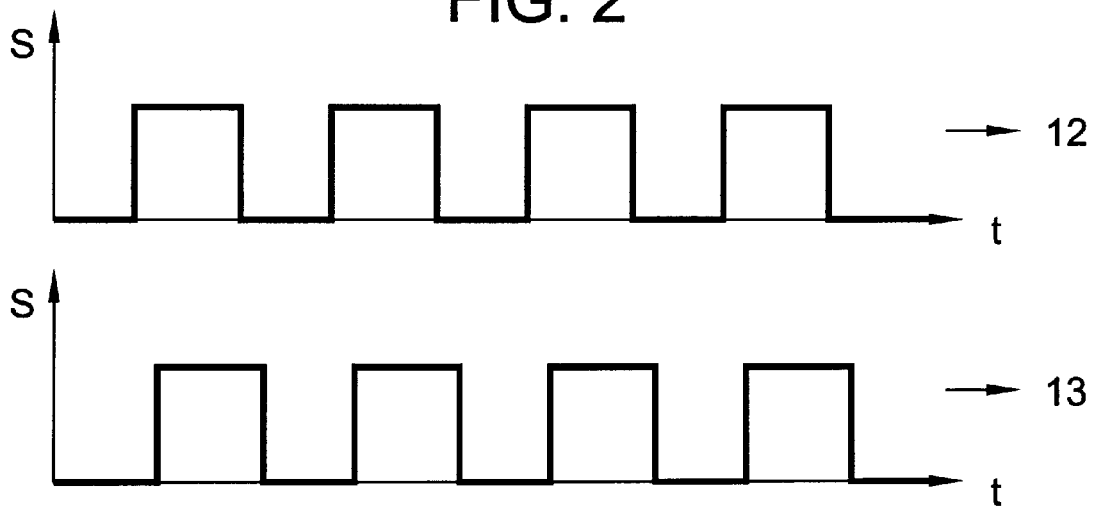
FIGS. 2 and 3 show the switching signals generated by the control unit for the synchronous-asynchronous movement of the main pile-carrying assembly and the auxiliary pile-carrying assembly.
Figure 3:
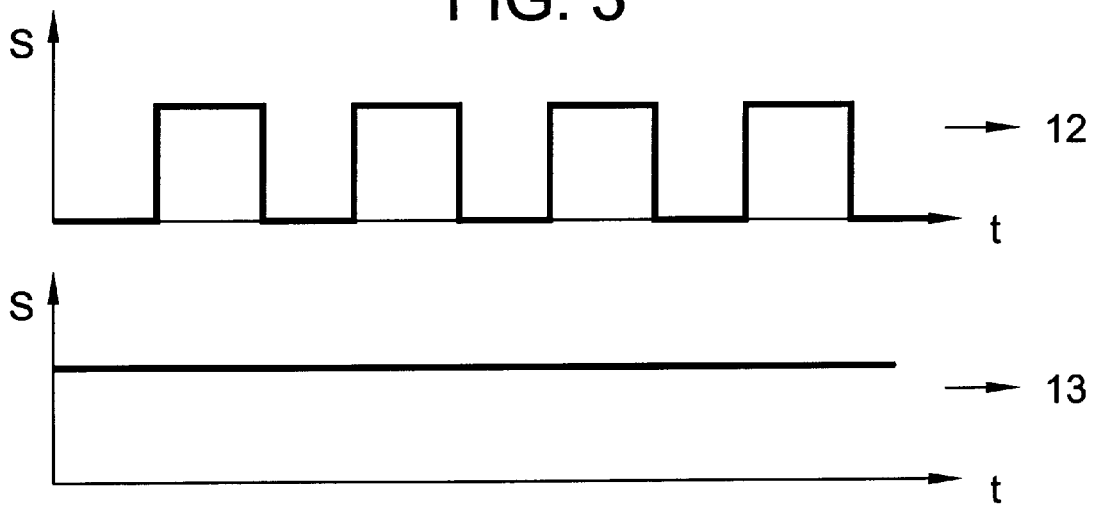

According to a preferred embodiment of the invention, provision is made for parameters to be assigned to drive unit 13, such that an identical switch-on time generated by control unit 14 and received by both drive control unit 12 of the feeder 2 and drive unit 13 of the auxiliary pile-carrying assembly 3 causes auxiliary pile-carrying assembly 3 and main pile-carrying assembly 19 of the feeder 2 to move identically. This means that the movements of motors 7 and 11 will have the same areas under their curves in their respective rotational-speed vs. time diagrams. FIG. 2 shows the switch-on signals, generated on the part of the control unit in conjunction with the pile height scanner 15, for drive units 12 and 13. The level of the switching signal S from control unit 14 is illustrated over time t. This represents the fact that the switching signal S for the drive unit 12 has a time lag with respect to the switching signal S for the drive unit 13 of the auxiliary pile-carrying assembly, although the lengths of the switching signals are equal throughout the "ON" state. With the switching signals illustrated in FIG. 2, the same lifting paths are traveled by main pile-carrying assembly 19 of the feeder 2 and auxiliary pile-carrying assembly 3 by means of the drive units 12 and 13 and the motors 7 and 11. FIG. 3 shows a variation of the switching signals from the control unit 14 for asynchronous operation of the motors 7 and 11. In the mode of operation illustrated here, drive unit 12 of motor 7 for feeder 2 continues to be operated in cycles by means of the control unit 14, i.e. the main pile-carrying assembly 19 moves as a function of the signals from the pile height scanner 15 (sensor), whereas a continuous switching signal S is transmitted to drive unit 13, so that drive unit 13 operates motor 11 at a maximum nominal rotational speed. In this case, auxiliary pile-carrying assembly 3 moves at a predetermined maximum speed.

What is claimed is:

1. A lifting system for an automatic pile changing device of a sheet-processing machine, the system comprising: a main pile-carrying assembly for moving a pile of sheets; an auxiliary pile-carrying assembly for moving either synchronously or asynchronously with respect to the main pile-carrying device; first and second drive units for driving the main and auxiliary pile-carrying assemblies, respectively; a control unit for providing a common control signal to the first and second drive units for synchronously driving the main and auxiliary pile-carrying assemblies; at least one of the drive units including a conversion means for converting the common control signal into a switch-on signal having frequency and duration attributes derived from differences between speed and acceleration characteristics of the main pile carrying assembly and the auxiliary pile carrying assembly, the switch-on signal causing the at least one drive unit to move its respective pile carrying assembly the same distance and speed as the other pile carrying assembly in response to the common control signal, thereby allowing for the synchronous driving of the main and auxiliary pile-carrying assemblies.

2. The lifting system of claim 1 further comprising a sensor connected to the control unit for detecting a height of a pile carried by the main pile-carrying assembly, the control unit responding to the sensor to generate the control signal.

3. The lifting system of claim 2 wherein said common drive signal is first and second control signals that are the same except for a time lag separating one from the other, the time lag being within a predefined tolerance.

4. The lifting system of claim 3 wherein said control unit is responsive to an input for switching to an asynchronous mode of operation wherein the first and second control signals are of different frequencies for asynchronous operation of the main and auxiliary pile-carrying assemblies.

5. The lifting system of claim 1 wherein the at least one drive unit is configured as a power supply controlled by a microprocessor, and the conversion means is a programmable memory associated with the microprocessor.

6. The lifting system of claim 1 wherein the conversion means is a programmable memory that is programmed with data correlating the relative rotational-speed and time response of the main and auxiliary pile-carrying assemblies.

7. The lifting system of claim 1, wherein the conversion means is a programmable memory having stored therein speed and acceleration characteristics of either the main or auxiliary pile-carrying assemblies.

8. The lifting system of claim 1, wherein the conversion means is a programmable memory having stored therein a look-up table having values representing switch-on frequencies and switch-on durations required for the drive to move its respective pile-carrying assembly the same distance as the other pile-carrying assembly in response to the same control signal, the system further comprising: a first motor coupled to the first drive unit for moving the main pile-carrying assembly in response to switch-on signals from the first drive unit; and a second motor coupled to the second drive unit for moving the auxiliary pile-carrying assembly in response to switch-on signals from the second drive unit, wherein the look-up table values are derived from observed differences between the first and second motors.

9. The lifting system of claim 1, wherein the conversion means is a programmable memory, the system further comprising: a first motor coupled to the first drive unit for moving the main pile-carrying assembly in response to switch-on signals from the first drive unit; and a second motor coupled to the second drive unit for moving the auxiliary pile-carrying assembly in response to switch-on signals from the second drive unit, wherein the programmable memory has stored therein a function for relating speed and acceleration characteristics of the first and second motors, the function being usable to convert switch-on signals calibrated for one of the motors into switch-on signals calibrated for the other motor.

10. A method of driving main and auxiliary pile-carrying assemblies either asynchronously or synchronously during a pile changing operation, each pile-carrying assembly having an associated drive, each pile-carrying assembly having different speed and acceleration characteristics, the method comprising the steps of: generating a common control signal controlling movement of both of the main and auxiliary pile-carrying assemblies; controlling the movement of each of the main and auxiliary pile-carrying assemblies by generating a common control signal, the common control signal being calibrated for the speed and acceleration characteristics of one of the assemblies; at the drive unit of the other pile-carrying assembly, converting the common control signal into switch-on signal having frequency and duration attributes derived from the differences in the speed and acceleration characteristics of the assemblies, thereby allowing the other pile-carrying assembly to move the same speed and distance as the pile-carrying assembly for which the control signal is calibrated.

11. The method of claim 10 wherein the main and auxiliary assemblies are driven asynchronously by different control signals.

12. A lifting system for an automatic pile changing device of a sheet-processing machine, the system comprising: a first and a second pile-carrying assembly, wherein one of the assemblies is a main pile-carrying assembly for moving a pile of sheets and the other assembly is an auxiliary pile-carrying assembly for moving either synchronously or asynchronously with respect to the main pile-carrying device; first and second drive units for driving the first and second pile-carrying assemblies, respectively; a control unit for providing a control signal to the first and second drive units, the control signal being calibrated to the speed and acceleration characteristics of the second pile-carrying assembly, wherein the first drive unit includes a microprocessor and a programmable memory coupled to the microprocessor, the programmable memory having stored therein parameters for relating the speed and acceleration characteristics of the first and second pile-carrying assemblies, the parameters being derived from observed differences between the first and second pile-carrying assemblies, wherein the microprocessor converts the common control signal into a switch-on signal based on the parameters, the switch-on signal having a frequency and duration to allow the first drive to move the first pile-carrying assembly over the same distance and at the same speed as the second pile-carrying assembly.

13. The lifting system of claim 12, wherein the programmable memory has stored therein a look-up table containing the parameters, the system further comprising: a first motor coupled to the first drive unit for moving the main pile-carrying assembly in response to switch-on signals from the first drive unit; and a second motor coupled to the second drive unit for moving the auxiliary pile-carrying assembly in response to switch-on signals from the second drive unit, wherein the look-up table parameters are derived from observed differences between the first and second motors.

14. The lifting system of claim 12, the system further comprising: a first motor coupled to the first drive unit for moving the main pile-carrying assembly in response to switch-on signals from the first drive unit; and a second motor coupled to the second drive unit for moving the auxiliary pile-carrying assembly in response to switch-on signals from the second drive unit, wherein the parameters comprise a function for relating speed and acceleration characteristics of the first and second motors, the function being usable to convert switch-on signals calibrated for one of the motors into switch-on signals calibrated for the other motor.

* * * * *